United States Patent [19]

Stahl

[11] 4,096,982

[45] Jun. 27, 1978

[54] AUTOMATIC MULTI NAIL DISPENSER

[76] Inventor: Michael Stahl, Box 65, Elie, Canada

[21] Appl. No.: 788,760

[22] Filed: Apr. 19, 1977

[51] Int. Cl.[2] ..... B25C 1/00

[52] U.S. Cl. ..... 227/113; 227/120

[58] Field of Search ..... 227/113, 120

[56] References Cited

U.S. PATENT DOCUMENTS

| | | | |
|---|---|---|---|
| 1,810,528 | 6/1931 | Peterson | 227/120 |
| 2,355,807 | 8/1944 | LaPlace | 227/120 |
| 2,409,049 | 10/1946 | Lang | 227/120 |
| 2,994,878 | 8/1961 | Abrahamsen | 227/120 |
| 3,238,983 | 3/1966 | Abrahamsen | 227/120 |
| 3,437,249 | 4/1969 | Baum | 227/120 |

*Primary Examiner*—Granville Y. Custer, Jr.
*Attorney, Agent, or Firm*—Stanley G. Ade

[57] ABSTRACT

A container contains a plurality of strips or rows of nails adhesively secured together and a wedge block splits off one row at a time for dispensing. The separated strip of nails is moved forwardly by means of a magnet so that the front nail of the strip is situated through an aperture and under a tappet. This tappet is struck lightly with a hammer which separates the front nail and enables it to be partially engaged within the work surface. The tappet is spring loaded or counterweighted in order to return it to the uppermost position.

13 Claims, 8 Drawing Figures

AUTOMATIC MULTI NAIL DISPENSER

BACKGROUND OF THE INVENTION

This invention relates to new and useful improvements in nail dispensers and is particularly suited for use by carpenters, construction workers, disabled people, handymen, farmers and the like in order to enable nails to be driven faster, safer and easier and with more comfort in cold weather than is possible with present devices.

Normally, nails are manually dispensed from a carpenter's apron with one hand and struck with a hammer held in the other hand. This is time consuming and often leads to damage to the hand holding the nail, particularly in cold weather.

Certain nail dispensers have been manufactured, but these are relatively expensive and are usually adapted for use by operators working in factories, utilizing mass production methods.

SUMMARY OF THE INVENTION

The present invention is a relatively simple structure adapted to hold five or six hundred nails at one time and which may be manipulated readily by one hand whereupon a slight blow with a hammer upon a tappet extending upwardly from the container, splits off one nail and partially drives it into the work surface whereupon the dispenser may be moved and the nail may be driven fully into position.

The container is easily held by one hand even in cold weather and this hand is, of course, remote from the tappet so that the danger of this hand being damaged is remote. If a disabled person is utilizing the dispenser, it may, as an example, be strapped to a forearm whereupon it may be operated in the usual way.

The dispenser comprises a container which is adapted to receive a plurality of rows of nails with the rows being adhesively secured together. A wedge plate separates one row from the block whereupon this one row is fed forwardly magnetically so that one nail projects under the tappet which may then be struck lightly with a hammer to separate this one nail and to drive it partially into the work surface.

Although magnets are used to urge the block of nails to one side and to urge the strips forwardly, nevertheless it will be appreciated that other methods such as springs or the like may be utilized if desired.

The principal object and essence of the invention is therefore to provide a nail dispenser in which a separated row or strip of nails may be fed forwardly one at a time so that individual nails may be separated from the row by striking a tappet lightly with a hammer.

Another object of the invention is to provide means whereby the front nail of the separated row is automatically positioned under the tappet ready for use.

Another object of the invention is to provide means whereby the tappet returns to the uppermost position once it has been struck.

A still further object of the invention is to provide a device of the character herewithin described which facilitates the rapid placement of nails even under winter conditions.

A still further object of the invention is to provide a device of the character herewithin described which is simple in construction, economical in manufacture and otherwise well suited to the purpose for which it is designed.

With the foregoing objects in view, and other such objects and advantages as will become apparent to those skilled in the art to which this invention relates as this specification proceeds, my invention consists essentially in the arrangement and construction of parts all as hereinafter more particularly described, reference being had to the accompanying drawings in which:

DESCRIPTION OF THE DRAWINGS

In the drawings like characters of reference indicate corresponding parts in the different figures.

DETAILED DESCRIPTION

Figure 1:
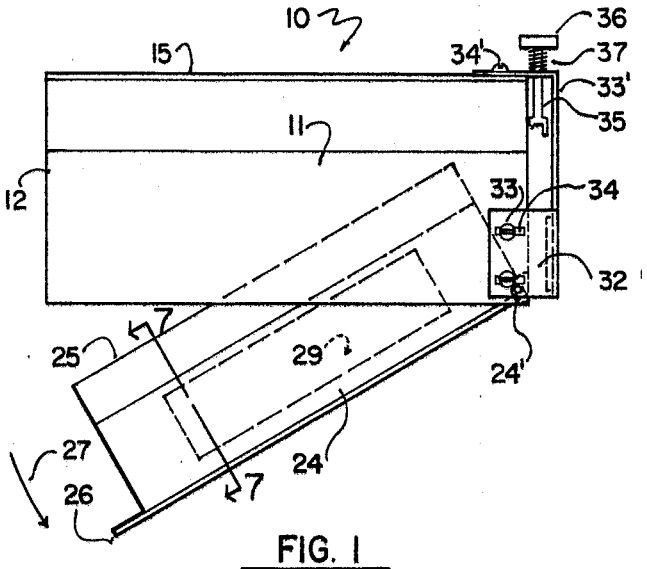
FIG. 1 is a side elevation showing the wedge plate in the partially lowered position.
Figure 5:
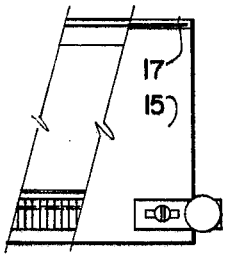
FIG. 5 is a fragmentary top plan view of one end of the dispenser illustrated in FIG. 1.
Figure 2:
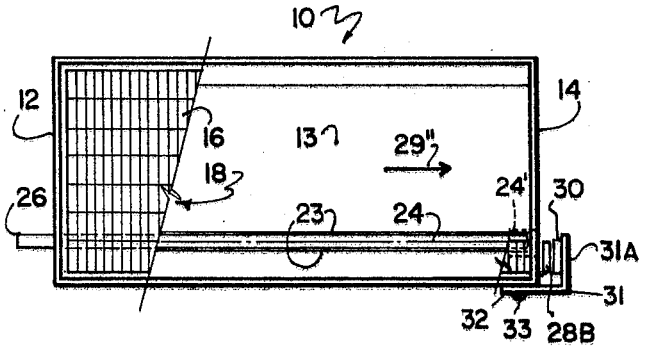
FIG. 2 is a top plan view of the device with the lid removed for clarity.

Proceeding therefore to describe the invention in detail, reference character 10 illustrates a container which includes a pair of side plates 11, a rear end plate 12, a base 13, a front end plate 14 and a hinged cover plate 15 all secured together to form the container. It will be noted that the sides 11 flare outwardly at the upper sides thereof to provide a convenient grip for the operator and also to allow additional room for the heads 16 of the nails being dispensed.

Figure 8:
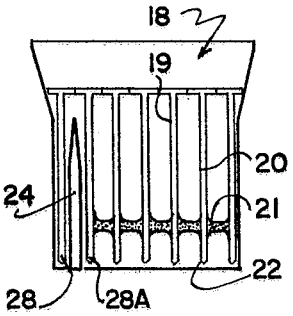
FIG. 8 is an end view of the block of nails with the wedge plate in position, the container being shown schematically.

The lid 15 is hinged to one upper side edge of one side 11 by means of a hinge pin 17 and this permits access to the interior of the container in order to place therewithin, the block of nails to be dispensed shown in FIG. 8 and collectively designated 18.

This block of nails comprises a plurality of rows 19 of nails 20, each nail being adhesively secured together in the conventional manner. A plurality of rows is in turn adhesively secured together by a bead of adhesive as indicated by reference character 21 and each nail is provided with the aforementioned substantially rectangular head 16 and the pointed lower end 22.

Adjacent one side 11 of the container, a longitudinally extending slot 23 is formed through the base plate 13 and a wedge plate 24 is pivoted to the front plate 14 adjacent the lower end of slot 29' so that the wedge plate engages through slot 23.

The wedge plate comprises an elongated member having a tapered upper edge 25 and an extending lower finger engaging portion 26. It is capable of being moved downwardly in the direction of arrow 27 to remove the wedge plate from the container and it is also capable of being moved upwardly in a direction opposite to arrow 27 so that it completely enters the container with the exception of the projecting portion 26 which extends beyond the end 12 of the container. When in the uppermost position illustrated in FIG. 8, it engages between the end row 28 of nails and the next succeeding row 28A and separates the adhesive 21 thus splitting off this end row so that it becomes a separated row of nails engaged between the wedge plate and one side wall 11 of the container.

This wedge plate preferably includes a strip of magnetic material 29 on the side against which row 28A engages and this magnetic material holds the remaining rows of nails against the wedge plate and in the upright position.

A vertical slot 29' is formed in the end wall 14 adjacent the side wall 11 against which the separated row of nails 28 loosely engages and this slot is of a size to permit exit of the end nail of this separated row 28, said row being specifically designated 28B.

Means are provided to urge the separated row or strip of nails 28 in the direction of arrow 29'' so that the end nail projects through the aperture and in this embodiment, a magnet 30 is secured to a bracket 31 spaced from the end wall 14.

It will be appreciated that a spring could be utilized to urge this separated strip of nails in the direction of arrow 29'' and a spring could also be used to maintain the unseparated rows of nails against the wedge block 24.

The bracket 31, in the embodiment shown, is a right angled bracket having an attaching portion 32 engaged to the side wall 11 by means of screws 33 within elongated slots 34 in the bracket portion 32 so that the distance of the bracket portion 31A may be adjusted within limits, relative to the end wall 14 thus providing the requisite space for the end nail 28B to project through the aperture 29'.

Tappet means are provided and in this connection two embodiments are illustrated.

Figure 3:
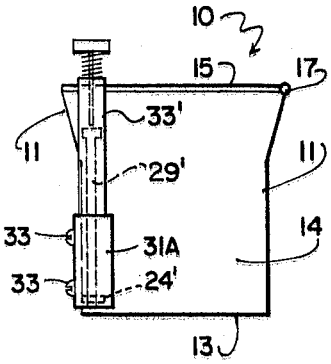
FIG. 3 is a front elevation of FIG. 1 showing one embodiment of the tappet assembly.

Dealing first with the tappet means illustrated in FIG. 3, a mounting block or bracket 33' is secured to the cover panel 15 by means of screw 34' and slight adjustment may be provided by means of an elongated slot in the mounting portion of block 33'.

The tappet 35 comprises a stem 35' journalled for reciprocal movement within block 33' and having a hammer engaging head 36 on the upper end thereof.

The tappet or plunger 35 is normally held in the uppermost position by means of a spring 37 reacting between the block 33' and the underside of the head 36.

Figure 6:
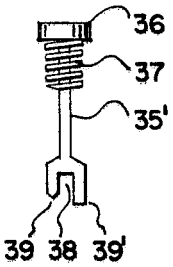
FIG. 6 is a fragmentary enlarged view of one embodiment of the tappet assembly per se.
Figure 7:
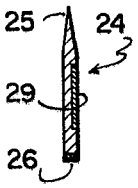
FIG. 7 is a fragmentary enlarged section along the line 7–7 of FIG. 1.

The lower end of the plunger 35 is preferably in the form shown in FIG. 6 which includes a nail head engaging portion 38 and a nail separating portion 39 situated just behind the portion 38. A guide portion 39' extends downwardly on the front side of the nail head engaging portion 38 and this engages within the inside of the portion 31 of the bracket.

The nail head engaging portion 38 is shaped to engage the rectangular head 16 of the nail 28B protruding through the aperture 29' so that if this plunger or tappet is struck lightly with a hammer on the head 36 thereof, the nail 28B is separated from the row 28 and driven downwardly to partially engage within the work surface upon which the dispenser may be placed.

The dispenser is then lifted clear of this nail which can then be driven in the normal manner and the tappet or plunger returns to the uppermost position whereupon magnet 30 draws the separated row 28 forwardly so that the next succeeding nail projects through the aperture 29 and is ready to be engaged by the portion 38 of the plunger when it is next struck.

Figure 4:
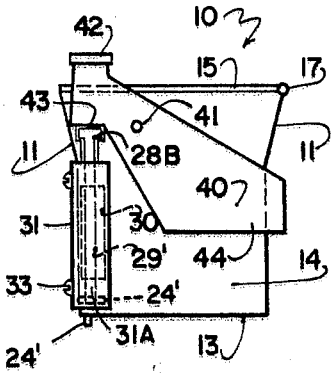
FIG. 4 is a view similar to FIG. 3, but showing an alternative construction of the tappet assembly.

FIG. 4 shows an alternative embodiment in which the tappet means comprises a plate 40 pivoted to the wall 14 by means of pivot pin 41 and having the hammer engaging portion 42 formed on the portion of the plate on one side of the pivot point 41.

Immediately below the hammer engaging portion 42, is the nail head engaging portion 43 situated immediately above the aperture 29' so that when it is moved downwardly, it engages the rectangular head 16 of the nail and operates in a manner similar to that hereinbefore described.

The portion 44 on the other side of pivot pin 41 is relatively heavy and normally maintains the plate in the position shown in FIG. 4 with the portions 42 and 43 in the uppermost position.

In either embodiment, the nails are fed forwardly by means of magnet 30 or spring means (not illustrated) ready for dispensing by light blow of the hammer upon the portions 36 or 42 of the tappet means.

It will, of course, be appreciated that more than one size of nail can be used. The dispenser can be used on existing compressed air or electric nailers or staplers to increase capacity.

In operation, the block of nails is inserted into the container with the heads uppermost and with the wedge plate in the open or fully extended position.

The wedge plate is then moved upwardly into the container separating the end row of nails and locating this end row between the wedge plate and the end wall and magnet 30 will engage the foremost nail of this separated wall.

Downward movement of tappet 42 will disengage this end nail 28B thus separating same from the row of nails and moving it downwardly to engage the material being nailed. The dispenser can then be lifted clear of this nail which can then be driven in the normal manner and the tappet or plunger returns to the uppermost position whereupon magnet 30 draws the separated row forwardly so that the next succeeding nail projects through aperture 29 and is ready to be engaged by the portion 28 of the plunger when it is next struck or moved downwardly.

The remaining block of nails is held against the wedge plate by means of magnet 29 and is thus prevented from rattling around within the dispenser which could separate individual nails from the block thus causing same to jam.

When the separated row has been used, the dispenser is tipped slightly towards the end wall adjacent the wedge plate whereupon the wedge plate is actuated by withdrawing same completely from the dispenser thus allowing the block of nails to move against the end wall so that the next row is ready for separation from the block as soon as the wedge plate is moved upwardly into position. The magnet is important particularly when there are only two or three rows of nails left in order to stop same separating as hereinbefore described but more importantly to stop same from tipping over sideways into the dispenser so that the dispenser would become inoperative.

Since various modifications can be made in my invention as hereinabove described, and many apparently widely different embodiments of same made within the spirit and scope of the claims without departing from such spirit and scope, it is intended that all matter contained in the accompanying specification shall be interpreted as illustrative only and not in a limiting sense.

What I claim as my invention is:

1. A nail dispenser adapted to be used with a block of nails consisting of a plurality of rows of nails, each row containing a plurality of nails in side by side relationship adhesively secured together, said rows being adhesively secured together to form said block, each nail having a head end and an engaging end; comprising in combination a container for said nails, means to selectively separate one row of nails from the remaining row of nails and to position said separated row of nails against one side wall of container, means to urge said separated row of nails towards one end of said container, said one end being apertured to receive one end of said separated row of nails, means to limit the movement of said separated row of nails through said aperture whereby one nail projects through said aperture with the head of said nail being uppermost; tappet means mounted on said one end of said container and situated over said one nail whereby downward movement of said tappet engages the lower side of said tappet upon the head of said one nail and separates if from the remainder of said separated row of nails, and means to return said tappet means to the uppermost position whereby said means to urge said separated row of nails towards said one end projects a further nail through said aperture ready to be engaged by said tappet means, said means to selectively separate one row of nails from the remaining rows of nails including a wedge plate pivoted by one end thereof to one end of said container, said container including a base, a slot in said base to receive said wedge plate, downward movement of said wedge plate disengaging said wedge plate from the interior of said container through said slot, upward movement of said wedge plate engaging said wedge plate within said container and between adjacent rows of nails to separate one row from the remaining rows of nails, and magnetic means on one side of said wedge plate to maintain said plurality of rows of nails against said one side of said wedge plate when said wedge plate is in said container and maintaining said rows of nails in the upright and operative position.

2. The dispenser according to claim 1 in which said means to urge said separated row of nails towards said one end of said container includes a magnet adjacent said one end engaged by the nail projecting through said aperture.

3. The dispenser according to claim 2 in which said tappet means includes a plate pivoted intermediate the ends thereof to said one end of said container, said plate including a nail head engaging portion on one side of the point of pivotal attachment of said plate and a counterweight on the other side of said point of pivotal attachment of said plate normally urging said nail head portion upwardly.

4. The dispenser according to claim 2 in which said means to limit the movement of said separated row of nails through said aperture includes a plate adjustably secured to said one end of said container and spaced from said aperture against which said separated row of nails engages, said magnet being mounted on said plate.

5. The dispenser according to claim 4 in which said tappet means includes a plunger mounted for reciprocal movement within said one end of said container above said aperture, said means to return said tappet means comprising a spring engaging between said container and said plunger normally urging said plunger upwardly, the lower end of said plunger including a nail head engaging portion and a nail separating portion.

6. The dispenser according to claim 5 in which said nail separating portion includes a wedge point on said lower end of said plunger just rearwardly of said nail head engaging means adapted to engage between adjacent nails when said plunger is moved downwardly.

7. The dispenser according to claim 2 in which said tappet means includes a plunger mounted for reciprocal movement within said one end of said container above said aperture, said means to return said tappet means comprising a spring engaging between said container and said plunger normally urging said plunger upwardly, the lower end of said plunger including a nail head engaging portion and a nail separating portion.

8. The dispenser according to claim 7 in which said nail separating portion includes a wedge point on said lower end of said plunger just rearwardly of said nail head engaging means adapted to engage between adjacent nails when said plunger is moved downwardly.

9. The dispenser according to claim 4 in which said tappet means includes a plate pivoted intermediate the ends thereof to said one end of said container, said plate including a nail head engaging portion on one side of the point of pivotal attachment of said plate and a counterweight on the other side of said point of pivotal attachment of said plate normally urging said nail head portion upwardly.

10. The dispenser according to claim 1 in which said means to limit the movement of said separated row of nails through said aperture includes a plate adjustably secured to said one end of said container and spaced from said aperture against which said separated row of nails engages.

11. The dispenser according to claim 1 in which said tappet means includes a plunger mounted for reciprocal movement within said one end of said container above said aperture, said means to return said tappet means comprising a spring engaging between said container and said plunger normally urging said plunger upwardly, the lower end of said plunger including a nail head engaging portion and a nail separating portion.

12. The dispenser according to claim 11 in which said nail separating portion includes a wedge point on said lower end of said plunger just rearwardly of said nail head engaging means adapted to engage between adjacent nails when said plunger is moved downwardly.

13. The dispenser according to claim 1 in which said tappet means includes a plate pivoted intermediate the ends thereof to said one end of said container, said plate including a nail head engaging portion on one side of the point of pivotal attachment of said plate and a counterweight on the other side of said point of pivotal attachment of said plate normally urging said nail head portion upwardly.

* * * * *